US012029305B2

(12) United States Patent
Shen

(10) Patent No.: US 12,029,305 B2
(45) Date of Patent: Jul. 9, 2024

(54) COSMETIC PACKAGE WITH REPLACEABLE CARTRIDGE

(71) Applicant: APR Beauty Group Inc., Toronto (CA)

(72) Inventor: Jun Shen, Lighthouse Point, FL (US)

(73) Assignee: APR Beauty Group Inc., Toronto (CA)

( * ) Notice: Subject to any disclaimer, the term of this patent is extended or adjusted under 35 U.S.C. 154(b) by 183 days.

(21) Appl. No.: 17/521,470

(22) Filed: Nov. 8, 2021

(65) Prior Publication Data

US 2023/0030527 A1 Feb. 2, 2023

(30) Foreign Application Priority Data

Aug. 2, 2021 (CN) ..... 202121779544.4

(51) Int. Cl.

| | |
|---|---|
| ***A45D 40/06*** | (2006.01) |
| ***A45D 34/00*** | (2006.01) |
| ***A45D 40/04*** | (2006.01) |
| *A45D 40/00* | (2006.01) |

(52) U.S. Cl.

CPC ..... *A45D 40/065* (2013.01); *A45D 34/00* (2013.01); *A45D 40/04* (2013.01); *A45D 40/06* (2013.01); *A45D 2034/005* (2013.01); *A45D 2040/0018* (2013.01); *A45D 2040/0043* (2013.01); *A45D 2040/0056* (2013.01)

(58) Field of Classification Search

CPC ..... A45D 40/04; A45D 40/06; A45D 40/065; A45D 2040/0043

See application file for complete search history.

(56) References Cited

U.S. PATENT DOCUMENTS

| | | | | |
|---|---|---|---|---|
| 11,033,091 | B2 * | 6/2021 | Wiesenthal | A45D 40/16 |
| 11,406,167 | B2 * | 8/2022 | Groffsky | A45D 40/04 |
| 11,547,198 | B2 * | 1/2023 | Thulin | A45D 40/04 |
| 2022/0304451 | A1 * | 9/2022 | Niemeyer | A45D 40/04 |

FOREIGN PATENT DOCUMENTS

| | | | |
|---|---|---|---|
| KR | 20-0393383 | Y1 | 8/2005 |
| WO | WO2020/013492 | A1 | 1/2020 |

* cited by examiner

*Primary Examiner* — Jennifer C Chiang

(74) *Attorney, Agent, or Firm* — Jason L. DeFrancesco

(57) ABSTRACT

A cosmetic package for dispensing a cosmetic product, the cosmetic package includes a replaceable cartridge for housing the cosmetic product. The cosmetic package further includes a bottle body and a screw member that is secured inside the bottle body such that the screw member does not have any axial or rotational movement relative to the bottle body. The replaceable cartridge comprises a sheath and a plate housed within the sheath. The sheath is rotatably engaged to the screw member, and moves up and down along the length of the screw member to hide or expose the cosmetic product housed in the sheath. The plate is stationary relative to the screw member when the sheath moves up and down. The sheath and the plate that can be replaced or refilled, while the bottle body, screw member, cover body of the cosmetic package can be retained for reuse.

20 Claims, 9 Drawing Sheets

COSMETIC PACKAGE WITH REPLACEABLE CARTRIDGE

This application claims priority from Chinese Utility Model 202121779544.4 filed on Aug. 2, 2021, the disclosure of which is incorporated herein by reference with DAS code #8F0E

BACKGROUND

Field

The present disclosure relates to a cosmetic package for discharging a cosmetic product. More specifically, the present disclosure is directed to a cosmetic package with a replaceable cartridge allowing for the replaceable cartridge to be changed without disposing of the whole cosmetic package.

DESCRIPTION OF THE RELATED ART

Cosmetic packages for dispensing solid, liquid, and/or gel cosmetic products are known. These cosmetic packages are limited to single use, and after depletion of the cosmetic product within the cosmetic package, the consumer is left with no other option but to dispose of the empty cosmetic package and purchase a new, full, cosmetic package. The problem with this type of single-use cosmetic package is that its single-use nature leads to excessive waste, thereby raising costs of manufacturing and reducing efficiency. This cause waste of resources and as the entire cosmetic package is difficult to degrade, it also pollute the environment.

To resolve environment pollution issue, environmentally friendly materials may be employed for making a cosmetic package, for example materials such as: paper, bamboo, wood, etc. As the cosmetic product in such cosmetic package such as a deodorant package or lip product package is extended or retracted by rotation, and the cosmetic package requires components that have threads for discharging the product through rotation. But when employing paper, bamboo, wood and other materials to make these components it is not easy to process threads on them.

Thus, there is a need to create a cosmetic package that allows for the consumer to only purchase replaceable cartridges instead of complete cosmetic packages. Further, it is desirable to have a replaceable cartridge made of an environmentally friendly material.

SUMMARY

It is an object of the present disclosure to provide a cosmetic package, configured to contain and dispense a cosmetic product, with a replaceable cartridge allowing for the cartridge to be changed without disposing of the whole cosmetic package.

As used herein, the term "cosmetic product" refers to any cosmetic product which may include for example, perfumes, colognes, lipstick, cosmetics, ointments, antiperspirants, deodorant, foundation stick, concealer stick, or any combinations thereof which may include those in liquid, gel, solid, powdered form, or any combinations thereof.

Accordingly there is provided a cosmetic package in accordance with a preferred embodiment of the present disclosure. The cosmetic package comprises a replaceable cartridge that accommodates a cosmetic product. The cosmetic package is configured to allow for selective insertion and removal of the replaceable cartridge to and from the cosmetic package. When the replaceable cartridge is coupled to the cosmetic package, the cosmetic package can be manipulated to dispense the cosmetic product from the replaceable cartridge. Upon depletion of the cosmetic product housed within the replaceable cartridge, the replaceable cartridge can be disposed of (or refilled with a new cosmetic product for subsequent use) and a new (or refilled) replaceable cartridge can be coupled to the cosmetic package for continued use.

According to an aspect of the present disclosure, the cosmetic package comprises a bottle body, a screw member, a cover body, a plate, and a sheath. The cover body covers the cosmetic package and protects the cosmetic package from dust and dirt. The replaceable cartridge includes the sheath and the plate that can be replaced or refilled, while the bottle body, screw member, cover body of the cosmetic package can be retained for reuse.

According to another aspect of the present disclosure, the bottle body is configured to receive at least a portion of the replaceable cartridge therein. The bottle body has a closed bottom end and an open upper end. The bottle body includes a bottom wall and at least one sidewall extending upward from the bottom wall. A lower portion of the screw member is housed within the bottle body and is connected to the bottle body such that the screw member does not have any linear or rotatable movement with respect to the bottle body. Particularly, a central post extends upwards from an inner surface of the bottom wall of the bottle body, and wherein a lower end of the screw member is connected to the central post. The central post and the screw member includes corresponding coupling features that allow the screw member to not have any axial or rotatable movement with respect to the bottle body.

According to another aspect of the present disclosure, the central post of the bottle body includes a sidewall comprising a peripheral convex protrusion on its outer surface and a plurality of protuberances that are distributed in a peripheral direction on the outer surface of the sidewall. Each of the plurality of protuberances of the bottle body is a truncated cone-shaped structure, and wherein each of the plurality of protuberances of the bottle body protrudes outward from the sidewall of the central post.

Further, there is provided a coupling protrusion on the outer surface of the sidewall near the upper end of the bottle body, and a corresponding coupling recess is provided on an inner surface of a sidewall of the cover body and wherein the coupling protrusion of the bottle body is snapped into the coupling recess of the cover body for removably connecting the cover body to the bottle body. In a preferred embodiment, the shape of the cover body is preferably circular in shape. However, the shape of the cover body may be rectangular, cuboidal, square, or other shapes known in the art.

According to another aspect of the present disclosure, the cover body and bottle body include features to detachably connect to each other. In the present embodiment, the bottle body comprises at least one coupling protrusion on its outer surface and the cover body includes a corresponding coupling recess at its inner surface for snap fitment. In alternative embodiments, the cover body and bottle body may be removably secured to each other by any other method known in the art.

According to yet another aspect of the present disclosure, the screw member of the present disclosure has a tube shaped body with a closed upper end and an open bottom end. The screw member has an upper wall and a sidewall that descends from the upper wall. The screw member includes a peripheral groove located at an inner surface of the sidewall proximal to the open bottom end of the screw member. Further, the screw member includes a plurality of the grooves that are uniformly distributed in a peripheral direction on the inner surface of the sidewall and wherein each of the plurality of grooves intersects the peripheral groove. Further, each of the plurality of grooves has a truncated cone-shaped structure.

When the screw member is mounted on the central post of the bottle body, the peripheral convex protrusion present on the outer surface of the central post is received in the peripheral groove located in the inner surface of the sidewall of the screw member prohibiting relative axial movement between screw member and bottle body, and the plurality of protuberances present on the outer surface of the central post are inserted into the corresponding plurality of the grooves present on the inner surface of the sidewall of screw member prohibiting relative rotational movement between the screw member and bottle body.

According to yet another aspect of the present disclosure, the screw member further includes a plurality of threads on an outer surface of the sidewall of the screw member. The plurality of threads is parallel to each other and arranged obliquely on the outer surface of the sidewall of the screw member. Further, each of the plurality of threads extends from the closed upper end of the screw member to the bottom end of the screw member.

According to yet another aspect of the present disclosure, the sheath according to the present disclosure has an upper end and a bottom end. The sheath is a cylindrical body that has a sidewall and a bottom wall. The bottom wall of the sheath is formed as an annular ring at the bottom end of the sheath that extends radially inward up to a certain radial extent and forming a central hole at the bottom end. At least one sheath protrusion, preferably, a plurality of sheath protrusions is provided on an inner edge of the bottom wall such that the plurality of sheath protrusions protrudes into the central hole of the sheath. The plurality of sheath protrusions is radial and is uniformly spaced. Further, a plurality of notches is formed between adjacent sheath protrusions of the plurality of sheath protrusions and wherein the plurality of notches match the plurality of threads. Each of the plurality of notches is convex. The plurality of notches is defined by circumferential gaps between adjacent sheath protrusions of the plurality of sheath protrusions. The plurality of notches is guided along the length of the plurality of threads so that the sheath can extend or retract along a length of the screw member.

According to another aspect of the present disclosure, the sheath can be made of any suitable material such as metal, plastic, wood, paper board, or any other suitable material known in the art. More preferably, the sheath is made of environmentally friendly materials such as paper, bamboo, wood, etc. The sheath of the present disclosure does not have threads but have the plurality of notches that is guided on the plurality of threads for propelling and retracting the sheath with respect to the screw member along a longitudinal direction of the cosmetic package. The plurality of notches is convenient to process during manufacturing and is smooth to use during operation.

According to yet another aspect of the present disclosure, the plate is housed inside the sheath, and when initially the sheath is in a completely extended state, the plate rests on a top surface of the bottom wall of the sheath. The upper wall of the screw member extends through the central hole of the sheath to provide support to a bottom surface of the plate. An inner space between the upper end of the sheath and above the plate houses the cosmetic product. The plate supports the cosmetic product housed in the sheath from a bottom side. Since, the bottom wall supports the plate the cosmetic product has good stability. The plate has a circular shape that is sized to fit inside the cylindrical body of the sheath. The plate is housed inside the sheath but not coupled to the sheath such that the sheath can move up and down with respect to the plate. The plate is stationary relative to the screw member and does not move with the sheath. An outer diameter of the plate is less than or equal to an inner diameter of the sidewall of the sheath, preferably peripheral edge of the plate fits the sidewall of the sheath such that movement of the sheath is not affected by the plate. Further, the outer diameter of the plate is larger than the diameter of the central hole of the sheath so that plate will not fall from the bottom end of the sheath after being assembled inside the sheath.

In an initial state before first use, the upper end of the sheath is covered by a cover sheet. The cover sheet covers the cosmetic product housed within the sheath. In order to access the cosmetic product for the first time, a user needs to remove the cover sheet after removing the cover and rotate the bottle body to make the sheath move downwards so that the cosmetic product is exposed for use. Depending on the direction of rotation, the sheath moves either downward or upward along the screw member to expose or accommodate the cosmetic product in the sheath respectively. When the sheath moves downward, the cosmetic product contained in the sheath is gradually exposed and when the sheath moves upwardly the cosmetic product is again peripherally enclosed by the sheath.

According to another aspect of the present disclosure, an outer surface of the bottle body may be covered with a first aluminum sleeve, and an outer surface of the cover body may be covered with a second aluminum sleeve. The first aluminum sleeve and the second aluminum sleeve can improve the appearance of the cosmetic package.

The bottle body has a reduced diameter portion formed near the upper end of the bottle body. The reduced diameter portion is reduced in outer diameter as compared with the rest of the sidewall of the bottle body. The coupling protrusion is provided on an outer surface of the reduced diameter portion of the sidewall of the bottle body.

Further, the aluminum sleeve is designed to fit over the bottle body, and is similar to the bottle body in shape. The aluminum sleeve has a bending part at an upper end thereof and wherein the bending part extends inward towards reduced diameter part engages with a step formed between the reduced diameter part and rest of the sidewall of the bottle body so that the aluminum sleeve does not fall out during normal use.

The material of the sheath and the plate may be chosen from a group consisting of paper, bamboo, wood, metal, plastic, or a combination thereof. When the material is paper, bamboo, a biodegradable material, the sheath and the plate can be recycled and degraded without polluting the environment.

In a preferred embodiment, the complete package is made of wooden material.

According to yet another aspect of the present disclosure, the replaceable cartridge includes the sheath and the plate. When the replaceable cartridge is coupled to the cosmetic package, the cosmetic package can be manipulated to dispense the cosmetic product from the replaceable cartridge. Upon depletion of the cosmetic product housed within the replaceable cartridge, the replaceable cartridge can be disposed of (or refilled with a new cosmetic product for subsequent use) while the rest of the cosmetic package can be retained and reused with a new (or refilled) replaceable cartridge that can be coupled to the cosmetic package for continued use.

In order to replace the replaceable cartridge, the user needs to remove the cover body, and while holding the bottle body stationery rotates the sheath in a direction (clockwise or anticlockwise) that causes the sheath to move axially upwards on the plurality of threads of the screw member. When the sheath has approached an upper end of the plurality of threads, the sheath gets disengaged from the screw member and removed along with the plate. A new replaceable cartridge can then be assembled with the cosmetic package or the existing replaceable cartridge may be refilled with a new cosmetic product and re-assembled with the cosmetic package.

It will be understood that the foregoing is only illustrative of the principles of the disclosure and that various modifications can be made by those skilled in the art without departing from the scope and spirit of the disclosure. For example, the shapes and/or sizes of various components can be different from the shapes and sizes are shown herein. As another example, the materials used for various components can be different from those mentioned specifically herein.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
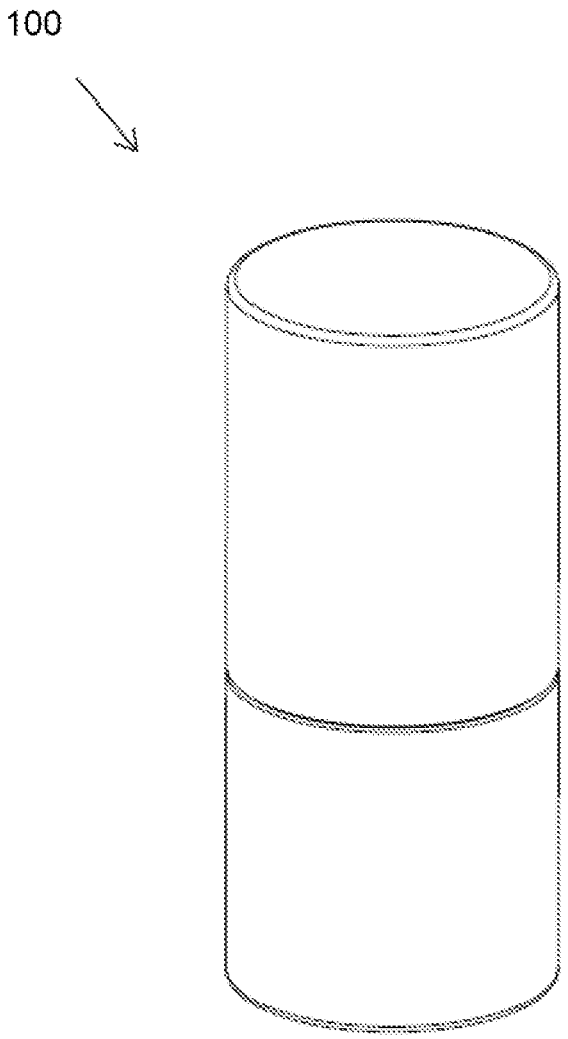
FIG. 1 is a perspective view of a cosmetic package in a closed state, according to an exemplary embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

Additionally, as used herein, the term "cosmetic product" refers to any cosmetic product which may include for example, perfumes, colognes, lipstick, cosmetics, ointments, antiperspirants, deodorant, foundation stick, concealer stick, or any combinations thereof which may include those in liquid, gel, solid, powdered form, or any combinations thereof.

Figure 2:
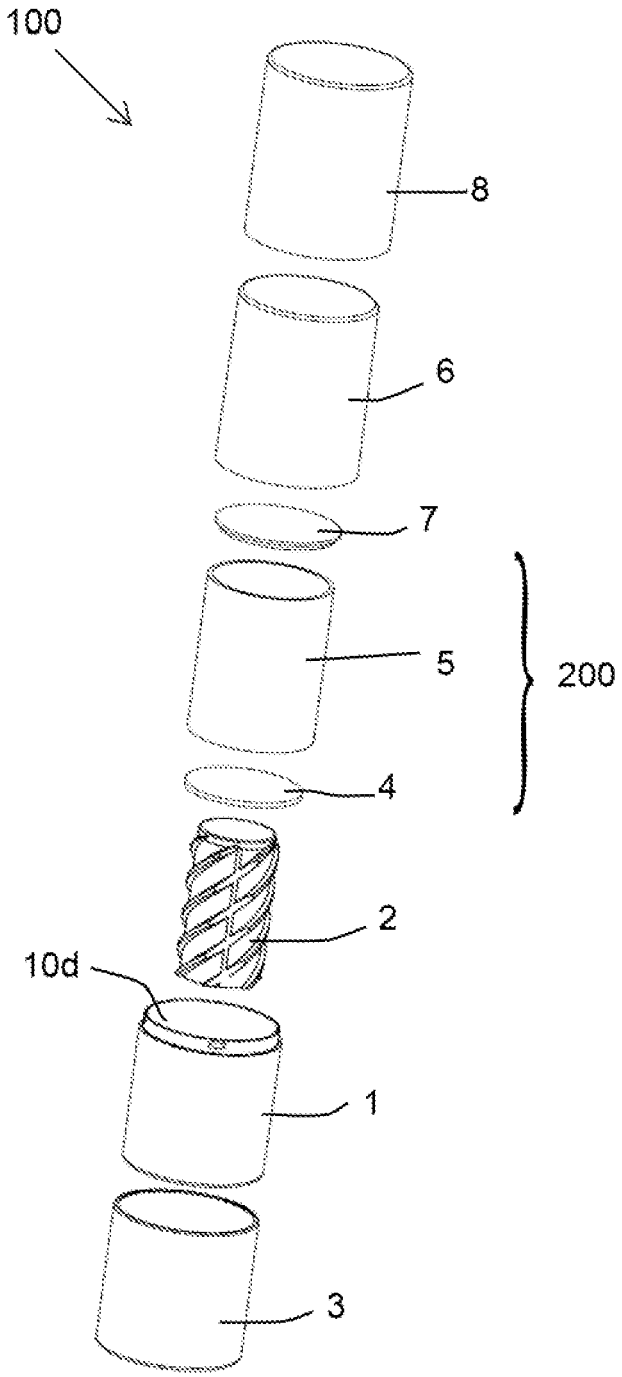
FIG. 2 is an exploded perspective view of the cosmetic package of FIG. 1.
Figure 3:
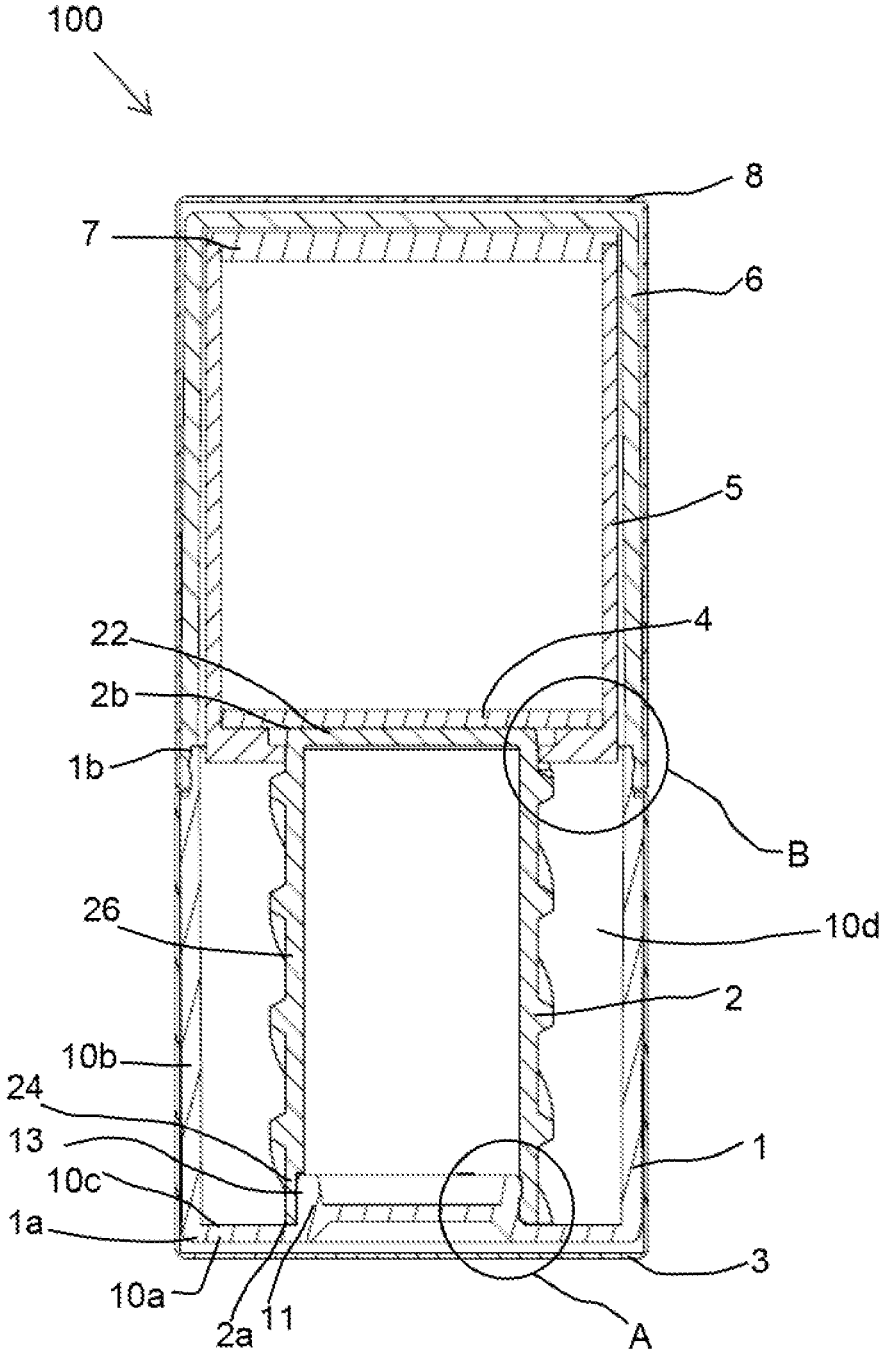
FIG. 3 is a longitudinal cross-sectional view of the cosmetic package of FIG. 1.

FIGS. 1 to 3 illustrates a cosmetic package 100 in accordance with a preferred embodiment of the present disclosure.

As will be described in detail below, the cosmetic package 100 comprises a replaceable cartridge 200 (see FIGS. 2 and 6) to accommodate a cosmetic product. The cosmetic package 100 is configured to allow for selective insertion and removal of the replaceable cartridge 200 to and from the cosmetic package 100.

Figure 6:
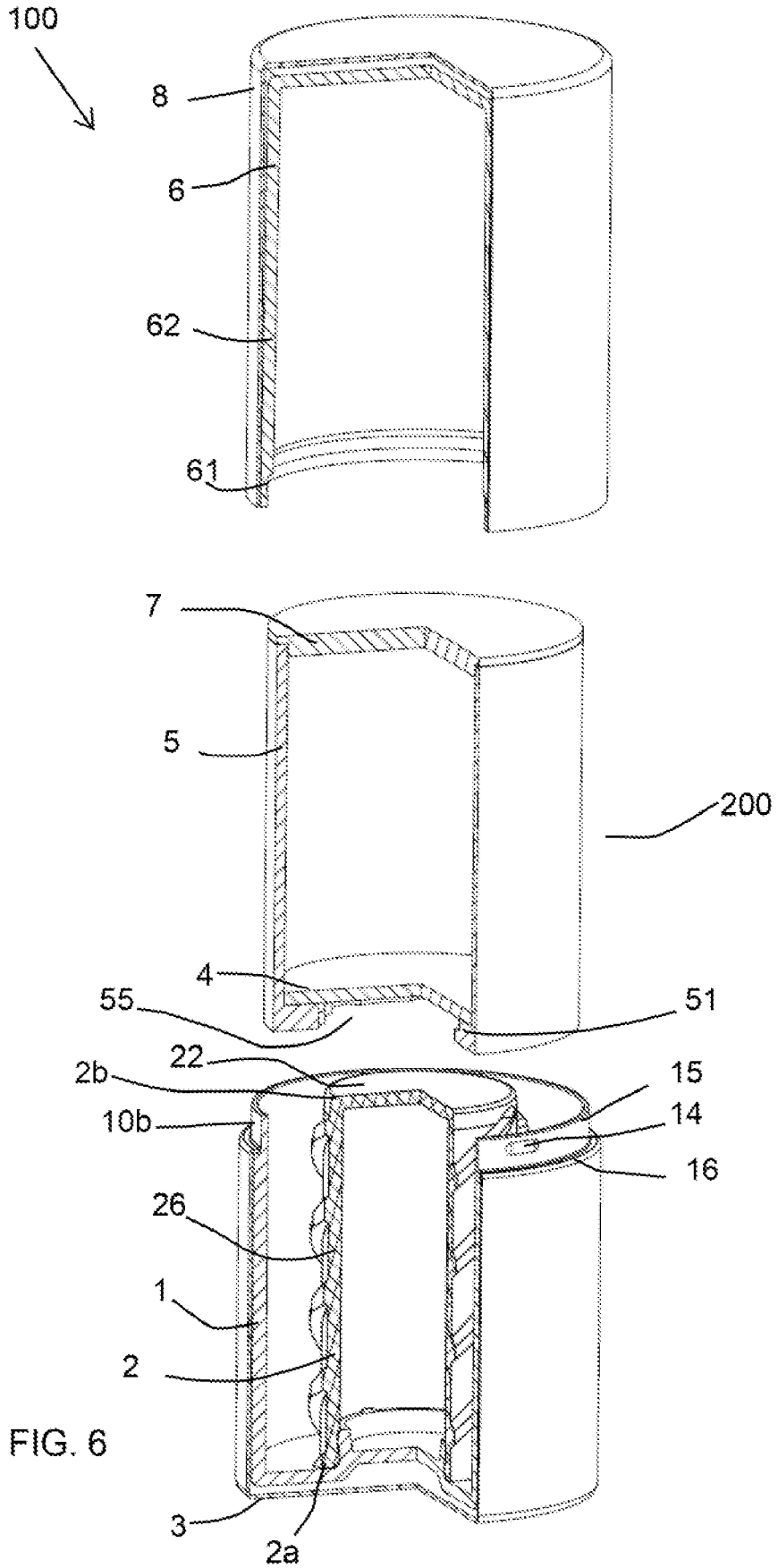
FIG. 6 is a perspective sectional view of the cosmetic package of FIG. 1.

Referring initially to FIGS. 2 and 6, the cosmetic package 100 includes a replaceable cartridge 200. The replaceable cartridge 200 is configured to house a cosmetic product (not shown) therein. When the replaceable cartridge 200 is coupled to the cosmetic package 100, the cosmetic package 100 can be manipulated to dispense the cosmetic product from the replaceable cartridge 200. Upon depletion of the cosmetic product housed within the replaceable cartridge 200, the replaceable cartridge 200 can be disposed of (or refilled with a new cosmetic product for subsequent use) and a new (or refilled) replaceable cartridge 200 can be coupled to the cosmetic package 100 for continued use.

With reference to FIGS. 2 and 3, the cosmetic package 100 comprises a bottle body 1, a screw member 2, a cover body 6, a plate 4, and a sheath 5. The cover body 6 covers the cosmetic package 100 and protects the cosmetic package 100 from dust and dirt. The replaceable cartridge 200 includes the sheath 5 and the plate 4 that can be replaced or refilled, while the bottle body 1, the screw member 2, the cover body 6 of the cosmetic package 100 can be retained for reuse.

Referring to FIG. 3, the bottle body 1 comprises an inner cavity 10*d* that is configured to receive at least a portion of the replaceable cartridge 200 therein. The bottle body has a closed bottom end 1*a* and an open upper end 1*b*. The bottle body 1 includes a bottom wall 10*a* and at least one sidewall 10*b* extending upward from the bottom wall 10*a*. The inner cavity 10*d* of the bottle body 1 is an interior volume encased by the sidewall 10*b* and the bottom wall 10*a*. A lower portion of the screw member 2 is housed within the inner cavity of the bottle body 1 and is connected to the bottle body 1 such that the screw member 2 does not have any linear or rotatable movement with respect to the bottle body 1. Particularly, a central post 11 extends upwards from an inner surface 10*c* of the bottom wall 10*a* of the bottle body 1, and wherein a bottom end 2*a* of the screw member 2 is connected to the central post 11. The central post 11 and the screw member 2 includes corresponding coupling features that allow the screw member 2 to not have any linear or rotatable movement with respect to the bottle body 1, the coupling features will be explained in more details below.

Figure 4:
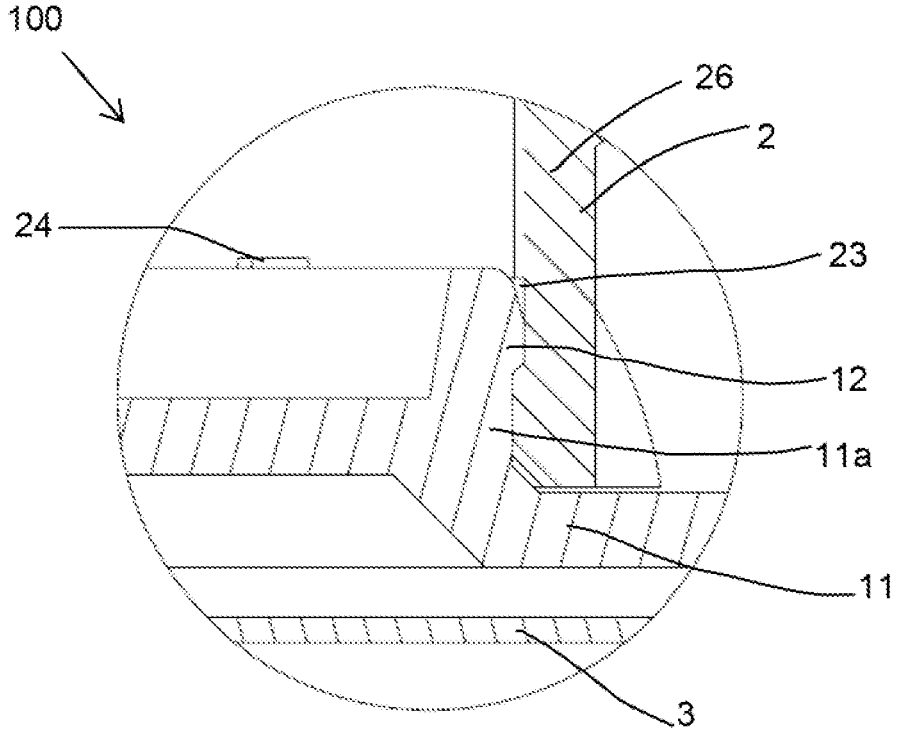
FIG. 4 is an enlarged cross-sectional view of the details of circle A in FIG. 3.
Figure 7:
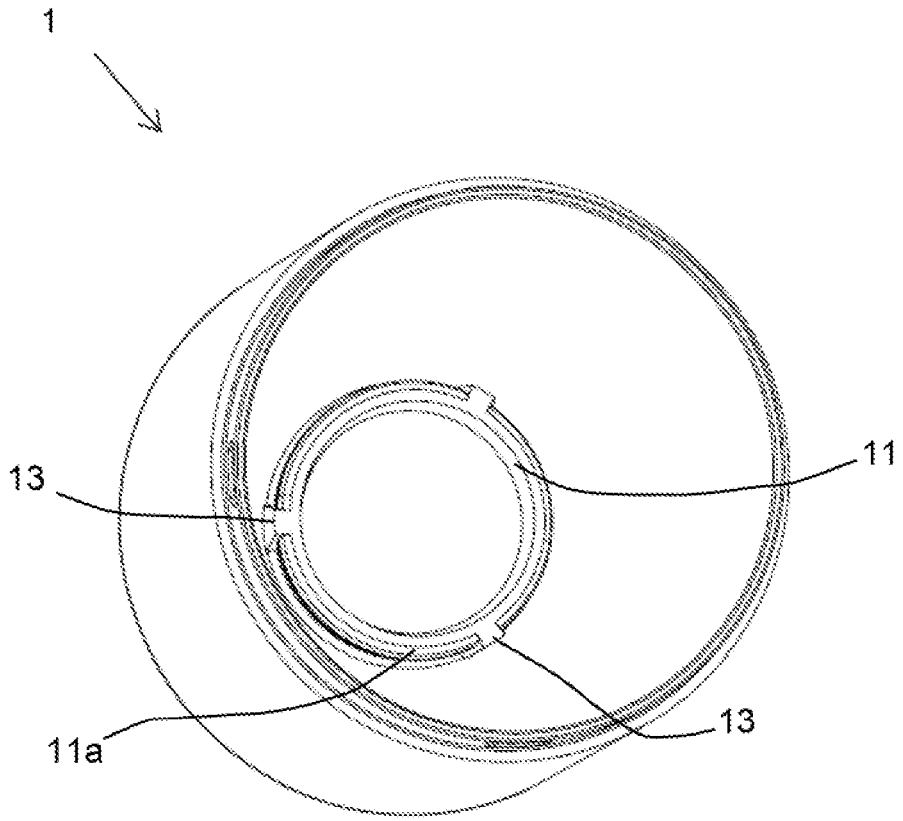
FIG. 7 is a perspective view of a bottle body of the cosmetic package of FIG. 2.

Referring now to FIGS. 4 and 7, the central post 11 of the bottle body 1 includes a sidewall 11*a* comprising a peripheral convex protrusion 12 on its outer surface and a plurality of protuberances 13 that are distributed in a peripheral direction on the outer surface of the sidewall 11*a*. Each of the plurality of protuberances 13 of the bottle body is a truncated cone-shaped structure, and wherein each of the plurality of protuberances 13 of the bottle body 1 protrudes outward from the sidewall 11*a* of the central post 11.

Figure 5:
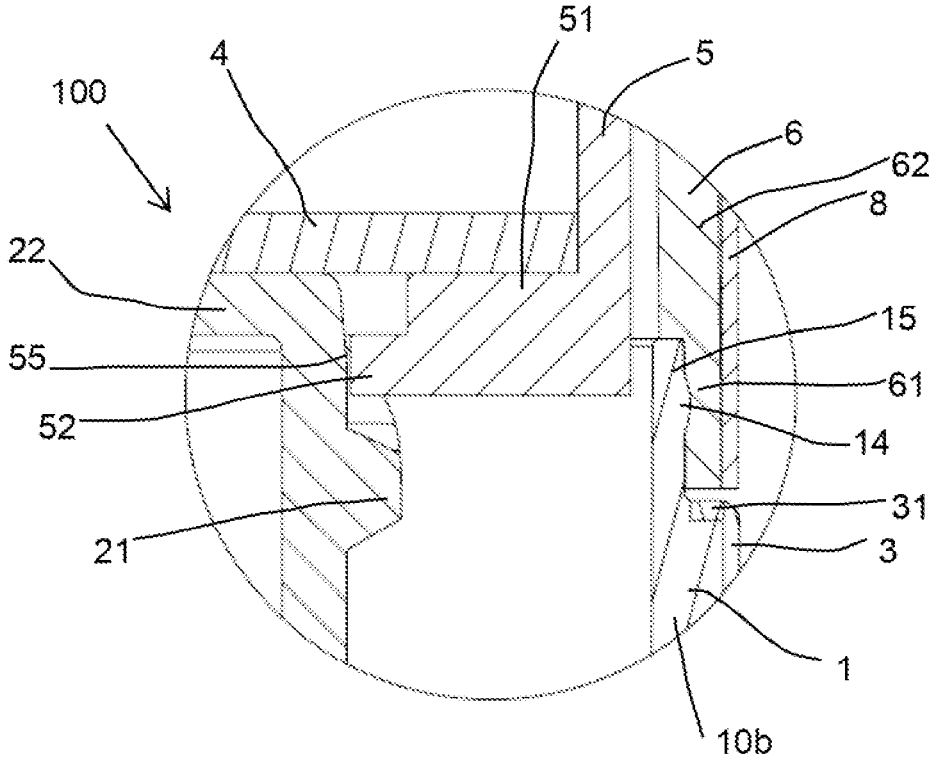
FIG. 5 is an enlarged cross-sectional view of the details of circle B in FIG. 3.

Further, as shown in FIGS. 5 and 6, there is provided a coupling protrusion 14 on the outer surface of the sidewall 10*b* near the upper end 1*b* of the bottle body 1, and a corresponding coupling recess 61 is provided on an inner surface of a sidewall 62 of the cover body 6 and wherein the coupling protrusion 14 of the bottle body 1 is snapped into the coupling recess 61 of the cover body 6 for removably connecting the cover body 6 to the bottle body 1. In the present embodiment, the shape of the cover body 6 is preferably circular in shape. However, the shape of the cover body 6 may be rectangular, cuboidal, square, or other shapes known in the art.

According to an aspect of the present disclosure, the cover body 6 and bottle body 1 include features to detachably connect to each other. In the present embodiment, the bottle body 1 comprises at least one coupling protrusion 14 on its outer surface and the cover body 6 includes the corresponding coupling recess 61 at its inner surface for snap fitment. In alternative embodiments, the cover body 6 and bottle body 1 may be removably secured to each other by any other method known in the art.

Figure 8:
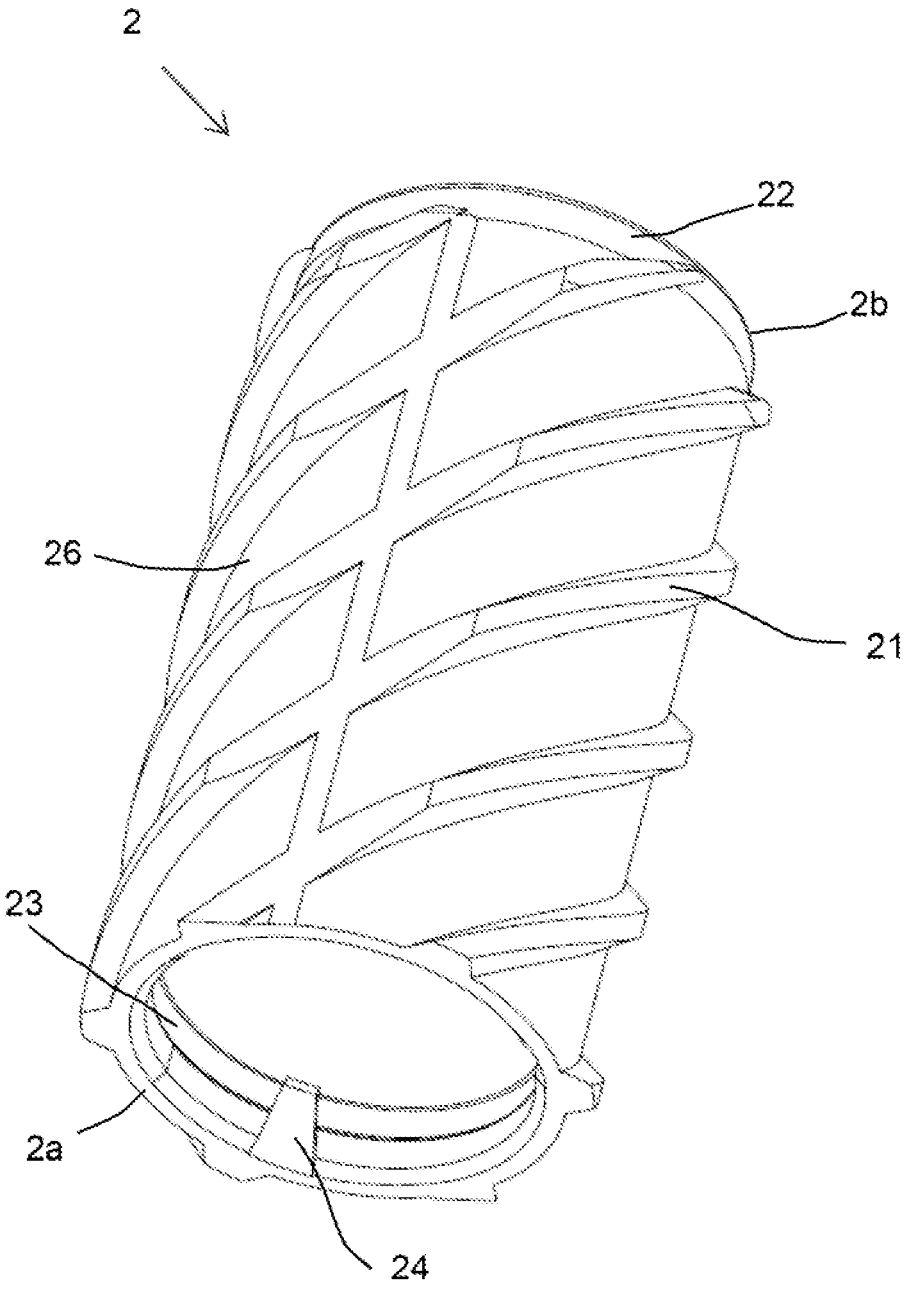
FIG. 8 is a perspective view of a screw member of the cosmetic package of FIG. 2.

Referring to FIGS. 3, 6 and 8, the screw member 2 of the present disclosure has a tube-shaped body with a closed upper end 2*b* and an open bottom end 2*a*. The screw member has an upper wall 22 and a sidewall 26 that descends from the upper wall 22. The screw member 2 includes a peripheral groove 23 (seen in FIG. 8) located at an inner surface of the sidewall 26 proximal to the open bottom end 2*a* of the screw member 2. Further, the screw member 2 includes a plurality of grooves 24 (seen in FIG. 8) that are uniformly distributed in a peripheral direction on the inner surface of the sidewall 26 and wherein each of the plurality of grooves 24 intersects the peripheral groove 23. Further, as seen, each of the plurality of grooves has a truncated cone-shaped structure.

When the screw member 2 is mounted on the central post 11 of the bottle body 1, the peripheral convex protrusion 12 present on the outer surface of the central post 11 is received in the peripheral groove 23 located in the inner surface of the sidewall 26 of the screw member 2 prohibiting relative axial movement between screw member 2 and bottle body 1 (see FIG.4), and the plurality of protuberances 13 present on the outer surface of the central post 11 are inserted into the corresponding plurality of grooves 24 present on the inner surface of the sidewall 26 of the screw member 2 prohibiting relative rotational movement between the screw member 2 and bottle body 1.

Referring to FIGS. 3, 6 and 8, the screw member 2 further includes a plurality of threads 21 on an outer surface of the sidewall 26 of the screw member 2. The plurality of threads 21 is parallel to each other and arranged obliquely on the outer surface of the sidewall of the screw member 2. Further, each of the plurality of threads 21 extends from the closed upper end 2*b* of the screw member 2 to the bottom end 2*a* of the screw member 2.

Figure 9:
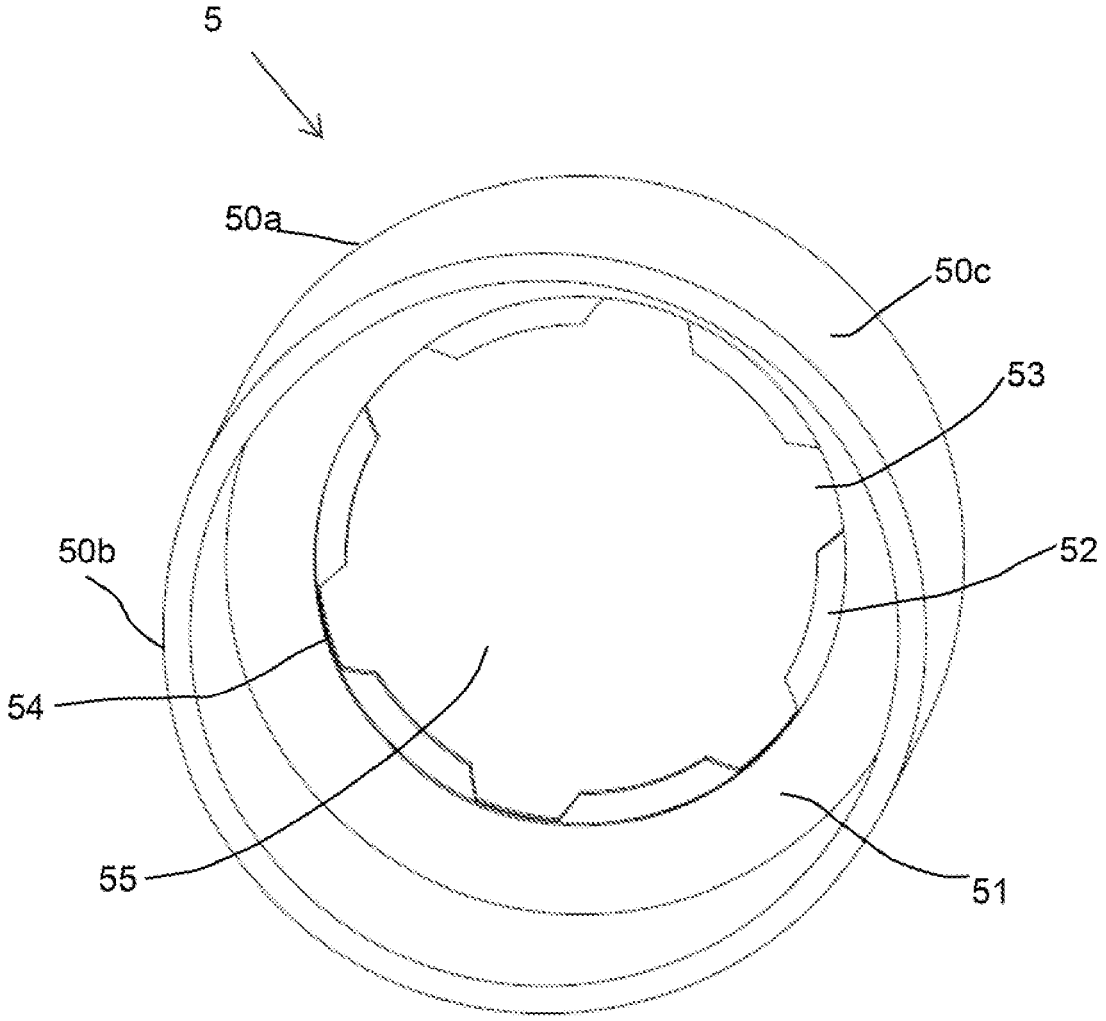
FIG. 9 is a perspective view of a sheath of the cosmetic package of FIG. 2.
Figure 10:
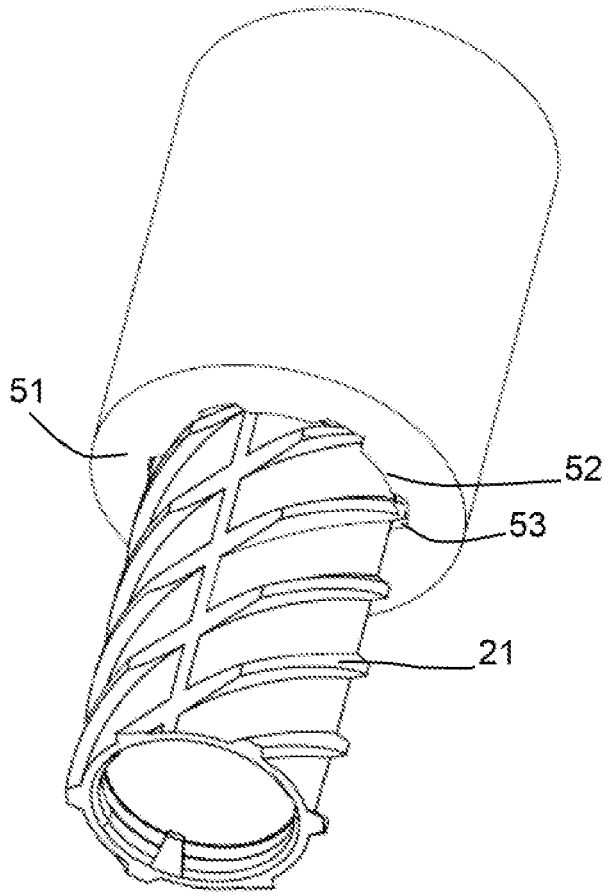
FIG. 10 a perspective view of the screw member engaged to the sheath of the cosmetic package of FIG. 2.

Referring to FIG. 9, the sheath 5 according to the present disclosure has an upper end 50*b* and a bottom end 50*s*. The sheath 5 is a cylindrical body that has a sidewall 50*c* and a bottom wall 51. The bottom wall 51 of the sheath 5 is formed as an annular ring at the bottom end 50S of the sheath 5 that extends radially inward up to a certain radial extent and forming a central hole 55 at the bottom end 50*a*. At least one sheath protrusion 52, preferably, a plurality of sheath protrusions 52 is provided on an inner edge 54 of the bottom wall 51 such that the plurality of sheath protrusions 52 protrudes into the central hole 55 of the sheath 5. The sheath protrusions of the plurality of sheath protrusions 52 are radial and are uniformly spaced. Further, a plurality of notches 53 is formed between adjacent sheath protrusions 52 of the plurality of the sheath protrusions 52 and wherein the plurality of notches 53 match the plurality of threads 21, see FIG. 10. The plurality of notches 53 is guided along the plurality of threads so that the sheath 5 can extend or retract along a length of the screw member 2. Each of the plurality of notches 53 is convex.

According to an aspect of the present disclosure, the sheath 5 can be made of any suitable material such as metal, plastic, wood, paper board, or any other suitable material known in the art. More preferably, the sheath 5 is made of environmentally friendly materials such as paper, bamboo, wood, etc. The sheath 5 of the present disclosure does not have threads but has the plurality of notches 53 that is guided on the plurality of threads 21 for propelling and retracting the sheath 5 with respect to the screw member 2 along a longitudinal direction of the cosmetic package 100. The plurality of notches 53 is convenient to process during manufacturing and is smooth to use during operation.

In a preferred embodiment, the complete package 100 is made of a wooden material.

As shown in FIGS. 5 and 6, the plate 4 is housed inside the sheath 5, and when initially the sheath 5 is in a completely extended state, the plate 4 rests on a top surface of the bottom wall 51 of the sheath 5. The upper wall 22 of the screw member 2 extends through the central hole 55 of the sheath 5 to provide support to a bottom surface of the plate 4. An inner space between the upper end 50*b* of the sheath 5 and above the plate 4 houses the cosmetic product. The plate 4 supports the cosmetic product housed in the sheath 5 from a bottom side. Since, the bottom wall 51 supports the plate 4 the cosmetic product has good stability. The plate 4 has a circular shape that is sized to fit inside the cylindrical body of the sheath 5. The plate 4 is housed inside the sheath 5 but not coupled to the sheath 5 such that the sheath 5 can move up and down with respect to the plate 4. The plate 4 is stationary relative to the screw member 2 and does not move up and down with the sheath 5, outer diameter of the plate 4 is less than or equal to an inner diameter of the sidewall 50*c* of the sheath 5, preferably peripheral edge of the plate 4 fits the sidewall 50*c* of the sheath 5 such that movement of the sheath 5 is not affected by the plate 4. Further, the outer diameter of the plate 4 is larger than the diameter of the central hole 55 of the sheath 5 so that plate 4 will not fall from the bottom end 50*a* of the sheath 5 after being assembled inside the sheath 5.

In an initial state before first use, an opening of the sheath 5 at the upper end 50*b* of the sheath 5 is covered by a cover sheet 7, see FIGS. 3 and 6. The cover sheet 7 covers the cosmetic product housed within the sheath 5. In order to access the cosmetic product for the first time, a user needs to remove the cover sheet 7 after removing the cover and rotate the bottle body 1 or the sheath 5 relative to one another to make the sheath 5 move downwards so that the cosmetic product is exposed for use. Depending on the direction of rotation, the sheath can moves either downward or upward along the screw member 2 to expose or accommodate the cosmetic product in the sheath 5 respectively. When the sheath 5 moves downward, the cosmetic product contained in the sheath 5 is gradually exposed and when the sheath 5 moves upwardly the cosmetic product is again peripherally enclosed by the sheath 5.

According to an aspect of the present disclosure, an outer surface of the bottle body 1 may be covered with a first aluminum sleeve 3, and an outer surface of the cover body 6 may be covered with a second aluminum sleeve 8, as shown in FIGS. 2, 3 and 6. The first aluminum sleeve 3 and the second aluminum sleeve 8 can improve the appearance of the cosmetic package 100.

As shown in FIGS. 5 and 6, the sidewall 10*b* of the bottle body 1 has a reduced diameter portion 15 formed near the upper end 1*b* of the bottle body 1. The reduced diameter portion 15 is reduced in outer diameter as compared with the rest of the sidewall 10*b* of the bottle body 1. The coupling protrusion 14 is provided on an outer surface of the reduced diameter portion 15 of the sidewall 10*b* of the bottle body 1.

Further, the aluminum sleeve 3 is designed to fit over the bottle body 1, and is similar to the bottle body 1 in shape. The aluminum sleeve 3 has a bending part 31 at an upper end thereof and wherein the bending part 31 extends inward towards reduced diameter part 15 engages with a step 16 formed between the reduced diameter part 15 and rest of the sidewall 10*b* of the bottle body 1 so that the aluminum sleeve 3 does not fall out during normal use.

The material of the sheath 5 and the plate 4 may be chosen from a group consisting of paper, bamboo, wood, metal, plastic, or a combination thereof. When the material is paper, bamboo, a biodegradable material, the sheath 5 and the plate 4 can be recycled and degraded without polluting the environment.

As seen in FIG. 6, the replaceable cartridge 200 includes the sheath 5 and the plate 4. When the replaceable cartridge 200 is coupled to the cosmetic package 100, the cosmetic package 100 can be manipulated to dispense the cosmetic product from the replaceable cartridge 200. Upon depletion of the cosmetic product housed within the replaceable cartridge 200, the replaceable cartridge 200 can be disposed of (or refilled with a new cosmetic product for subsequent use) while the rest of the cosmetic package 100 can be retained and reused with a new (or refilled) replaceable cartridge 200 that can be coupled to the cosmetic package 100 for continued use.

In order to replace the replaceable cartridge 200, the user needs to remove the cover body 6 and rotate the sheath 5 relative to the bottle body 1 either in a clockwise or an anticlockwise direction that corresponds to a relative upward movement of the sheath 5 on the plurality of threads 21 of the screw member 2. When the sheath 5 has approached an upper end of the plurality of threads 21, the sheath 5 gets disengaged from the screw member 2 and removed along with the plate 4. A new replaceable cartridge 200 can then be assembled with the cosmetic package 100 or the existing replaceable cartridge 200 may be refilled with a new cosmetic product and re-assembled with the cosmetic package 100.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A cosmetic package for dispensing a cosmetic product comprising:

a bottle body comprising an inner cavity:

a screw member housed in the inner cavity of the bottle body;

a replaceable cartridge removably connected to the screw member;

wherein the replaceable cartridge includes a sheath and a plate;

wherein the screw member is secured to the bottle body such that the screw member does not have any axial or rotatable movement with respect to the bottle body;

wherein the screw member includes a plurality of threads on an outer surface of a sidewall of the screw member, the plurality of threads extends from one end of the screw member to another end of the screw member;

wherein the sheath has a sidewall and a bottom wall, and wherein the sheath includes a plurality of notches at a bottom end of the sheath;

wherein each of the plurality of notches engages with a corresponding thread of the plurality of threads such that when the sheath is rotatable relative to the screw member, the plurality of notches of the sheath is guided along a length of the plurality of threads of the screw member so that the sheath can move upwards or downwards along a length of the screw member depending on the direction of rotation of the sheath relative to the screw member;

wherein the plate is located inside the sheath near the bottom end of the sheath;

wherein the cosmetic product is provided in an inner space of the sheath above the plate;

wherein the cosmetic product is exposed for use when the sheath moves downwards relative to the screw member;

wherein the cosmetic product is hidden in the sheath when the sheath moves upwards relative to the screw member; and wherein when the sheath moves upwards and downwards relative to the screw member, the plate is stationary relative to the screw member.

2. The cosmetic package according to claim 1, the cosmetic package includes a cover body that detachably engages with the bottle body to cover, and wherein the complete cosmetic package is made of a wooden material.

3. The cosmetic package according to claim 2, wherein at least one coupling recess is provided on an inner surface of a sidewall of the cover body; at least one coupling protrusion is provided on an outer surface of a sidewall of the bottle body; wherein the at least one coupling protrusion of the bottle body is snapped into the at least one coupling recess of the cover body for removably connecting the cover body to the bottle body.

4. The cosmetic package according to claim 1, wherein a central post extends upwards from an inner surface of a bottom wall of the bottle body, and wherein the central post of the bottle body includes a sidewall.

5. The cosmetic package according to claim 4, wherein an outer surface of the sidewall of the central post includes a peripheral convex protrusion, and wherein the screw member includes a peripheral groove located at an inner surface of the sidewall of the screw member proximal to an open bottom end of the screw member; and wherein the peripheral convex protrusion of the central post is received in the peripheral groove of the screw member prohibiting relative axial movement between the screw member and the bottle body.

6. The cosmetic package according to claim 4, wherein an outer surface of the sidewall of the central post includes a plurality of protuberances that are distributed in a peripheral direction on the outer surface of the sidewall of the central post; and wherein the screw member includes a plurality of grooves that are uniformly distributed in a peripheral direction on an inner surface of the sidewall of the screw member;

and wherein the plurality of protuberances of the central post are inserted into the plurality of grooves of the screw member to prohibit relative rotational movement between the screw member and the bottle body.

7. The cosmetic package according to claim 6, wherein each of the plurality of grooves and each of the plurality of protuberances has a truncated cone-shaped structure.

8. The cosmetic package according to claim 1, wherein the plurality of threads is parallel to each other and arranged obliquely on the outer surface of the sidewall of the screw member, and wherein each of the plurality of threads extends from a closed upper end of the screw member to an open bottom end of the screw member.

9. The cosmetic package according to claim 1, wherein the bottom wall of the sheath is formed as an annular ring at the bottom end of the sheath that extends radially inward up to a certain radial extent forming a central hole in the bottom wall.

10. The cosmetic package according to claim 9, wherein a plurality of sheath protrusions is provided on an inner edge of the bottom wall of the sheath such that the plurality of sheath protrusions protrudes into the central hole of the sheath, and wherein the plurality of notches is defined by circumferential gaps between adjacent sheath protrusions of the plurality of sheath protrusions.

11. The cosmetic package according to claim 1, wherein the cosmetic package is made of a material selected from a group consisting of metal, plastic, wood, paper board, and combinations thereof.

12. The cosmetic package according to claim 1, wherein an upper wall of the screw member extends through a central hole provided in the bottom wall of the sheath to provide support to a bottom surface of the plate.

13. The cosmetic package according to claim 1, wherein the plate has a circular shape that is sized to fit inside a cylindrical body of the sheath.

14. The cosmetic package according to claim 1, wherein an outer diameter of the plate is less than or equal to an inner diameter of the sidewall of the sheath; and wherein the outer diameter of the plate is larger than a diameter of a central hole of the sheath.

15. The cosmetic package according to claim 1, wherein before first use, an upper end of the sheath is covered by a cover sheet; and wherein to access the cosmetic product for the first time the cover sheet needs to be removed.

16. The cosmetic package according to claim 2, wherein an outer surface of the bottle body is covered with a first aluminum sleeve, and an outer surface of the cover body is covered with a second aluminum sleeve.

17. The cosmetic package according to claim 16, wherein the bottle body has a reduced diameter portion formed near an upper end of the bottle body; wherein the reduced diameter portion is reduced in outer diameter as compared with the rest of a sidewall of the bottle body; and wherein the first aluminum sleeve has a bending part at an upper end thereof that extends inward towards reduced diameter part and engages with a step formed between the reduced diameter part and the rest of the sidewall of the bottle body.

18. The cosmetic package according to claim 17, wherein the cosmetic product is selected from a group consisting of perfume, cologne, lipstick, foundation stick, concealer stick, ointment, antiperspirant, and a deodorant; and wherein the cosmetic product has a form selected from a group consisting of solid, paste, compact powder and gel material.

19. A cosmetic package for dispensing a cosmetic product comprising:

a bottle body having a bottom wall and at least one sidewall extending upward from the bottom wall;

a screw member having an upper wall and a sidewall, the screw member is housed in the bottle body and is connected to the bottom wall of the bottle body such that the screw member does not have any axial or rotatable movement with respect to the bottle body;

a sheath having a sidewall and a bottom wall, and wherein the sheath includes a plurality of notches at a bottom end of the sheath;

a plate is located inside the sheath near the bottom end of the sheath;

wherein the cosmetic product is provided in an inner space of the sheath above the plate;

wherein the sheath and the plate constitutes a replaceable cartridge that can be removed from the cosmetic package after depletion of the cosmetic product;

wherein the screw member includes a plurality of threads on an outer surface of the sidewall of the screw member;

wherein the plurality of notches engages with the plurality of threads such that when the sheath is rotatable relative to the screw member, the plurality of notches of the sheath is guided along the plurality of threads of the screw member so that the sheath can move upwards or downwards along a length of the screw member depending on the direction of rotation of the sheath relative to the screw member;

wherein when the sheath moves downwards relative to the screw member the cosmetic product is exposed for use;

wherein when the sheath moves upwards relative to the screw member the cosmetic product is contained in the sheath; and wherein when the sheath moves upwards and downwards relative to the screw member and the plate; and wherein to replace the replaceable cartridge, the bottle body is held stationary and the sheath is rotated in a direction that causes the sheath to move axially upwards until the sheath reaches an upper end of the plurality of threads located on the outer surface of the screw member and disengages from the screw member along with the plate.

20. A cosmetic package for dispensing a cosmetic product comprising:

a bottle body having a bottom wall and at least one sidewall extending upward from the bottom wall;

a screw member housed in the bottle body such that the screw member does not have any axial or rotatable movement with respect to the bottle body;

a sheath having a sidewall and an inner space;

a plate is located in the inner space the sheath near the bottom end of the sheath;

wherein the cosmetic product is provided in the inner space of the sheath above the plate;

wherein the sheath and the plate constitutes a replaceable cartridge that can be removed from the cosmetic package after depletion of the cosmetic product;

wherein the screw member includes a plurality of threads on an outer surface of the sidewall of the screw member;

wherein the sheath is rotatably engaged to the screw member;

wherein the sheath can move upwards or downwards along a length of the screw member depending on the direction of rotation of the sheath relative to the screw member;

wherein when the sheath moves downwards relative to the screw member the cosmetic product is exposed for use;

wherein when the sheath moves upwards relative to the screw member the cosmetic product hides in the sheath;

wherein the plate is stationary relative to the screw member; and wherein the cosmetic package is made of a wood material.

* * * * *